United States Patent [19]

Hurst

[11] Patent Number: 5,056,265

[45] Date of Patent: Oct. 15, 1991

[54] TUBE END ABRADING TOOL

[76] Inventor: Richard H. Hurst, P.O. Box 628, Kettle Falls, Wash. 99141

[21] Appl. No.: 486,087

[22] Filed: Feb. 27, 1990

[51] Int. Cl.[5] ..... B24B 5/12

[52] U.S. Cl. ..... 51/5 B; 51/181 NT; 51/73 R; 51/170 PT; 51/290; 15/104.04; 15/104.1 R

[58] Field of Search ..... 51/5 B, 4, 181 R, 181 NT, 51/73 R, 290, 288, 382; 7/157; 15/104.03, 104.05, 104.09, 104.1 R, 23, 104.04, 210 B

[56] References Cited

U.S. PATENT DOCUMENTS

| | | | |
|---|---|---|---|
| 1,717,554 | 6/1929 | Fraser | 51/181 NT |
| 2,593,735 | 4/1952 | Delzell | 51/73 |
| 2,793,473 | 5/1957 | Hickman | 51/73 |
| 3,187,361 | 6/1965 | Wheeler | 15/88 |
| 3,188,674 | 6/1965 | Hobbs | 51/73 |
| 3,266,075 | 8/1966 | Conrad | 15/104.03 |
| 3,335,526 | 8/1967 | Weiss | 51/73 |
| 3,343,192 | 9/1967 | Goldstein et al. | 15/23 |
| 3,436,783 | 4/1969 | McCartney | 15/104.03 |
| 3,793,782 | 2/1974 | Bowling | 51/170 PT |
| 4,137,588 | 2/1979 | Sandt et al. | 15/22 R |
| 4,238,867 | 12/1980 | Ruggero et al. | 15/88 |
| 4,246,728 | 1/1981 | Leasher | 15/104.05 |
| 4,372,003 | 2/1983 | Toelke | 15/88 |
| 4,433,448 | 2/1984 | True | 15/88 |

FOREIGN PATENT DOCUMENTS

| | | | |
|---|---|---|---|
| 1031561 | 6/1966 | United Kingdom | 15/104.04 |

*Primary Examiner*—Robert A. Rose

*Attorney, Agent, or Firm*—Wells, St. John & Roberts, PS

[57] ABSTRACT

A tool for abrading tube ends and fittings is described. The device includes an elongated handle enclosing a battery and driver. A reducer is also supplied at the top end of the handle for tranmitting and reducing rotary velocity of the driver to rotational motion of a pair of abrader heads. The preferred driver is a worm and worm wheel arrangement. The worm wheels are connected to paired, parallel shafts. Forward ends of the shafts mount abrader heads, each including a removable sleeve mounted abrasive member formed in a torus configuration for receiving a tube end. A reamer may be releasably mounted within one or both of the abrader heads to selectively engage and ream the tube end. A male abrader is mountable to the top end of the handle for connection to the driver. It includes a dome shaped abrasive member mounted to a shank for a selective attachment and detachment from the device. The handle and shaft are configured, along with the driver and reducer, to reduce dimensions of the unit and facilitate its use in confined quarters.

22 Claims, 4 Drawing Sheets

72
30
73
76
34
57
46
28
36
38
37
49
27
24
19
23
25
26
18
22
20
21
35
62
75
74
61
29
51
39
47
48
63
68
43
58
66
69

TUBE END ABRADING TOOL

TECHNICAL FIELD

The present invention relates to apparatus for abrading the ends of tubular workpieces and fittings attachable to the workpiece ends.

BACKGROUND OF THE INVENTION

Copper tubing and plastic pipe used for standard plumbing purposes are typically cut to length and joined by fittings to conform to various configurations, and to receive various flow-controlling apparatus. Copper tubing is generally joined by copper fittings. Such fittings are connected to the tubing by soldering. Plastic fittings, used with plastic tubing are secured by adhesive. In both soldering and gluing procedures it is recommended that the tube ends be abraded to clean the outside surfaces, and to slightly roughen the surface texture to accept the solder or glue. The inside surfaces of the fittings are also similarly abraded. Paste or a preparatory material is then applied to the tube end to assure acceptance of the solder or glue about the complete circumference of the joint to assure that no leaks will occur when the joint is assembled.

The typical process used to clean either form of pipe is to manually rub the external pipe end and mating surface of the fitting with an abrasive material such as abrasive paper, steel wool, abrasive pads or cloths, etc. Next a preparatory paste or flux is applied to the joint before the pieces are fitted together for soldering or, in the case of plastic pipe, before the glue is applied to the prepared male end of the tube. When considering the number of fittings and joints to be applied at the typical work site, the cleaning and preparatory process represents a significant amount of time.

It therefore becomes desirable to obtain some form of apparatus that will quickly and effectively clean tube ends at a high rate of speed while assuring that the entire circumference of the tubular workpiece is effectively cleaned.

As an attempted solution, a tube abrading tool is shown in U.S. Pat. No. 4,238,867. This tool includes a handle enclosing a battery pack fitted about an electrical motor. The motor includes a drive shaft that extends to opposite sides of the motor. One end of the drive shaft is connected directly to a male abrader drum and the opposite drive shaft is connected to a female abrasive member. Both abrasive members are wire brushes. There is no provision, other than changing the abrading members, for adapting the tool to different size tubing. The motor and the radially oriented battery mounts, substantially enlarge the diameter of the handle, which would be fairly difficult for the user to grasp. The length of the tool with the motor being situated between the two abrasive members is such that the unit could not effectively be used in confined quarters, as between studs or joists where tubing ends are typically situated. Even assuming the motor could develop sufficient torque to directly drive the cleaning devices, the overall length dimension of the apparatus severely limits its utility at in situ construction.

U.S. Pat. Nos. 3,436,783, 3,187,361, 3,343,192 and 4,433,448, each disclose pipe cleaning devices that also include cleaning brushes mounted to the ends of motor drive shafts or in which the cleaning brushes are axially arranged axially in relation to the overall length dimension of the tool. Use of the cleaners shown in these references is limited by their overall lengths.

U.S. Pat. No. 4,372,003 discloses a pipe thread cleaning device that makes use of a number of rotating cleaning brushes connected to a housing. The brushes are mounted to a rotating head which is driven by an angularly offset driving device. The operating handle, however, is offset both from the rotating cleaning wheels and the drive apparatus. The overall construction is therefore relatively bulky and no provision is made for cleaning internal surfaces of the pipe.

U.S. Pat. No. 4,137,588 discloses a portable device that is intended for use in general household cleaning. To this end, the disclosure specifically relates to a drive that oscillates or reciprocates selected attached implements. No disclosure is made with regard to features that would enable the device to clean the entire external periphery of tubing ends, or the interior periphery of a tubing fitting.

Even with the above apparatus, a need remains for a tool that will quickly and effectively clean fittings and tubing ends, such as copper and plastic pipe, especially in common situations where the tubing ends are located with exposed ends situated in confined areas.

BRIEF DESCRIPTION OF THE DRAWINGS

A preferred embodiment of the present invention is illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
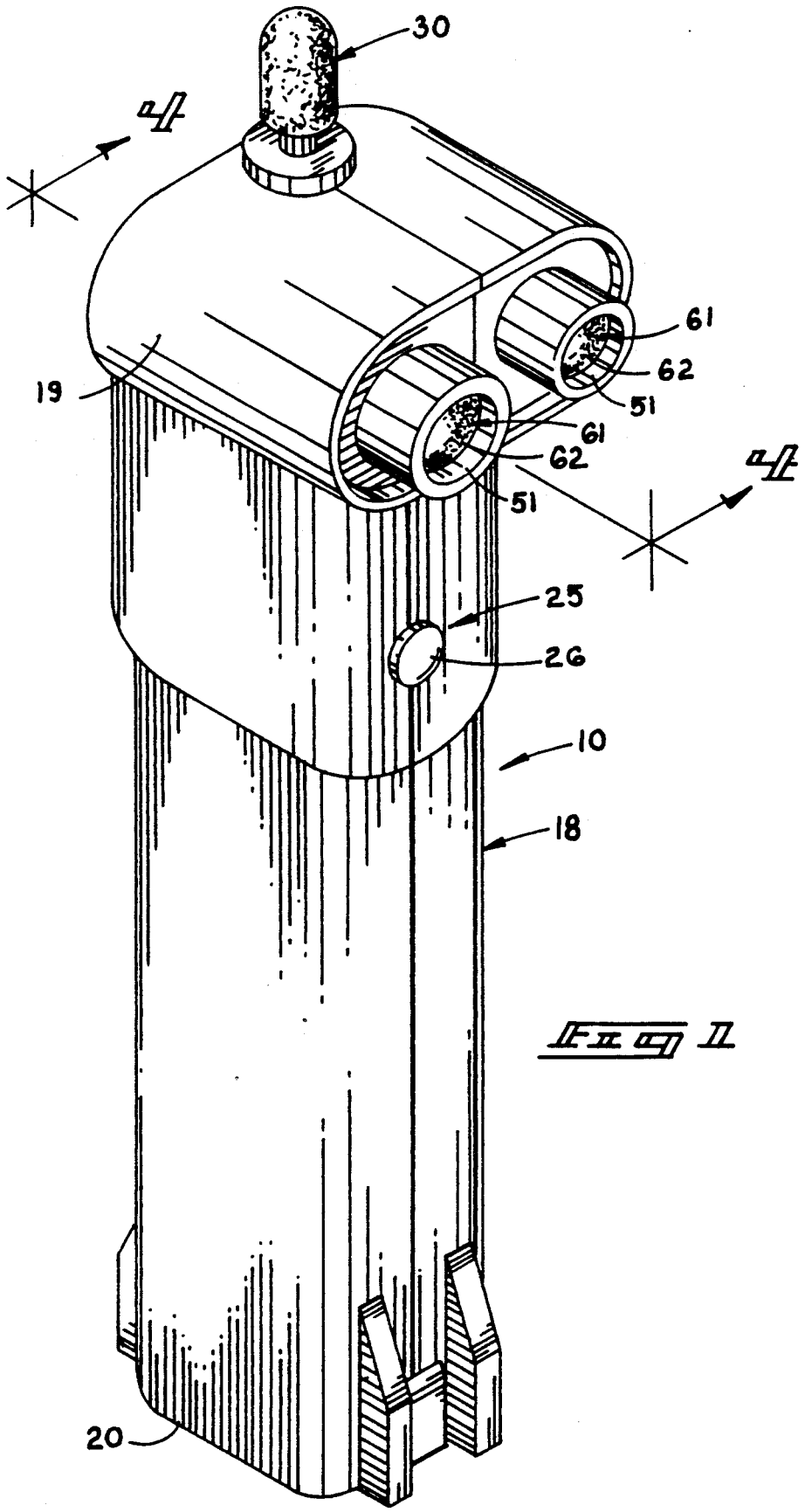
FIG. 1 is a perspective view of a preferred form of the tube end abrading tool.
Figure 2:
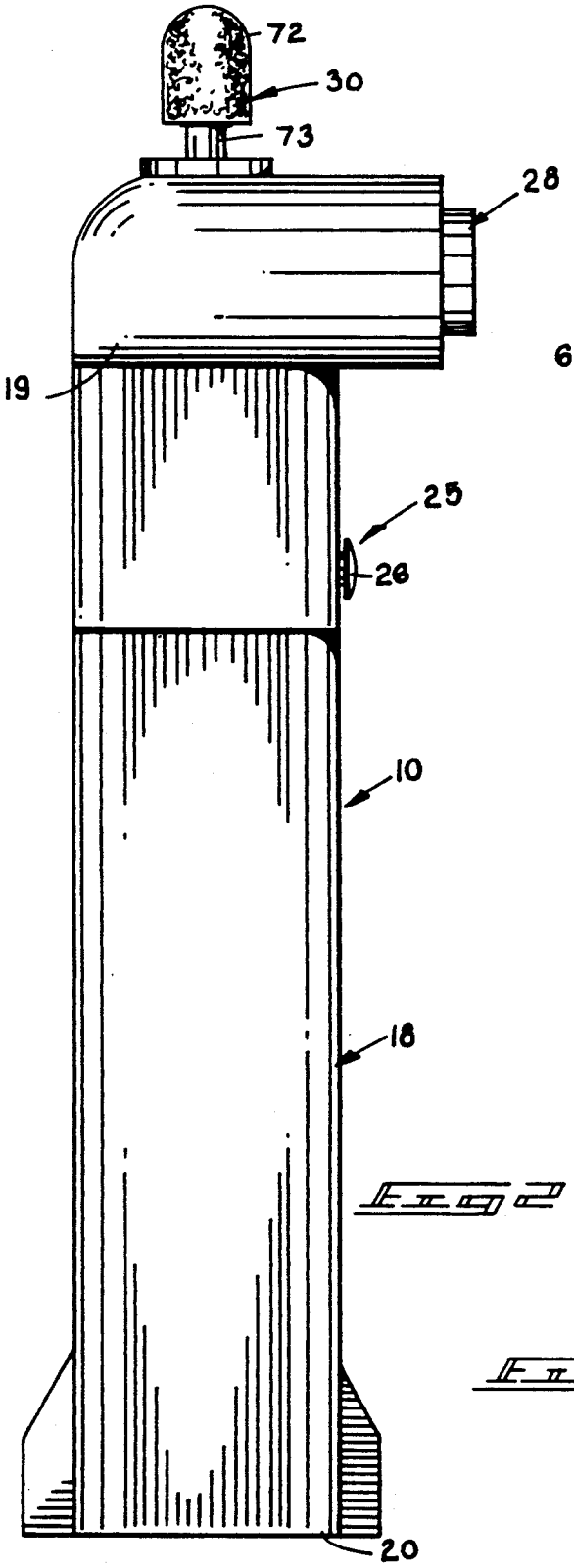
FIG. 2 is a side elevation view thereof, the opposite side being a mirror image thereof.
Figure 3:
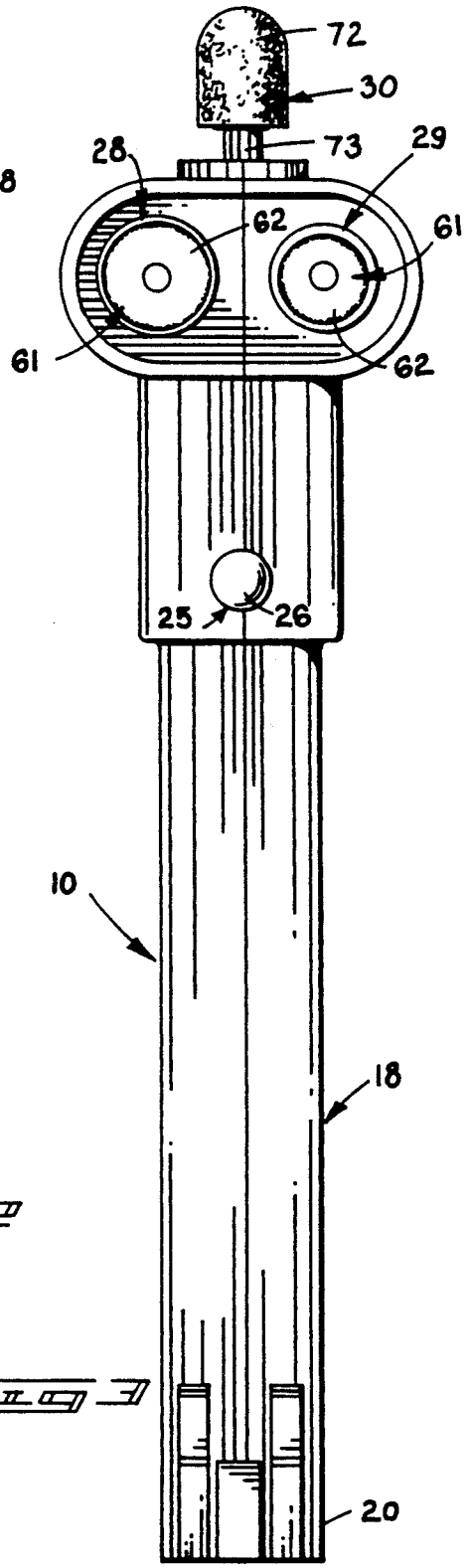
FIG. 3 is a frontal view as seen from the right in FIG. 2.
Figure 8:
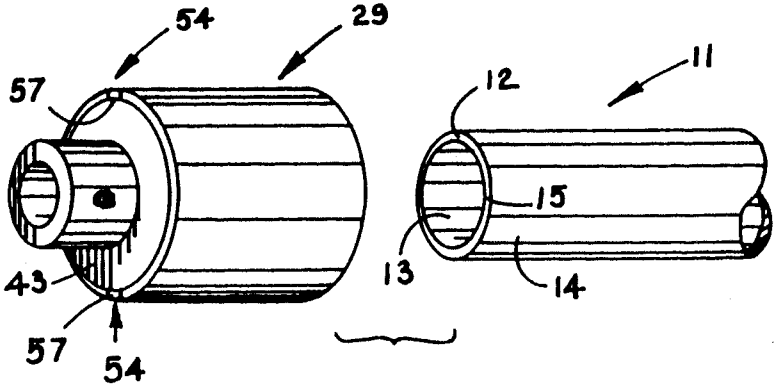
FIG. 8 is an exploded perspective view of an abrader head and an end section of a tubular workpiece.

The present device is identified in the drawings by the reference numeral 10. Device 10 (FIGS. 1) is provided to abrade selected surfaces of a tubular workpiece 11 (FIG. 8) or a fitting (not shown) for such a workpiece.

For purposes of this disclosure, the workpiece or tube 11 is described as including an end 12, an interior surface 13, an external surface 14, and an end edge 15. Such tubing may be standard relatively cylindrical tubing such as copper pipe used in commercial and residential plumbing construction. Likewise the workpiece may be plastic pipe and appropriate fittings that are used in similar commercial, residential, or industrial applications.

Tubing 11 and fittings come in relatively standard sizes, especially for residential construction. For example, it is very common to utilize one-half and three-fourths inch diameter copper tubing in residential construction. The two different diameter tubings are used primarily throughout all residential construction in which local building codes require water supply systems of copper tubing. Other sizes may be used in commercial or industrial application or with plastic tubing in areas where such tubing is acceptable. The present invention is intended to be produced with different size abraders to accommodate different tubing and fitting sizes and materials.

In referring now to the drawings in further detail, it will be seen that the present device 10 includes an elongated handle 18. The handle may be formed of injection molded plastic by conventional molding practices. The handle 18 extends between a top end 19 and a bottom end 20.

A hinged lid 21 (FIG. 4) may advantageously be provided at the bottom handle end 20. The lid 21 provides access to an internal battery 22 releasably carried within a receptacle within the handgrip porion of the handle. It is preferred that the battery 22 be rechargeable, of the type commonly used in various rechargeable electric power tools such as drills, saws, etc.

The battery 22 delivers electrical energy to a driver 23 such as a conventional electric motor. The driver 23 is mounted within the handle above and in line with the battery to minimize the width dimension of the handle for easy gripping during use. The driver includes a drive shaft 24, extending upwardly opposite the battery toward the top end 19 of the handle 18.

The drive shaft 24 is continuously rotatable about a driver axis in response to electrical energy received from the battery 22. To selectively control such rotation, a switch 25 and appropriate circuitry is provided on the handle 18. The switch 25 and circuitry may be of conventional momentary contact design, similar to those used in conventional electric drills.

The switch 25 is actuated to activate the motor upon depression of an appropriate trigger or plunger 26. The plunger 26 is positioned on the handle 18 for easy access by the user's fingers or thumb while the remainder of the user's hand grips the handle 18. This enables one hand operation of the device and frees the other hand to secure the workpiece 11 or fitting.

Figures 4, 5, 6:
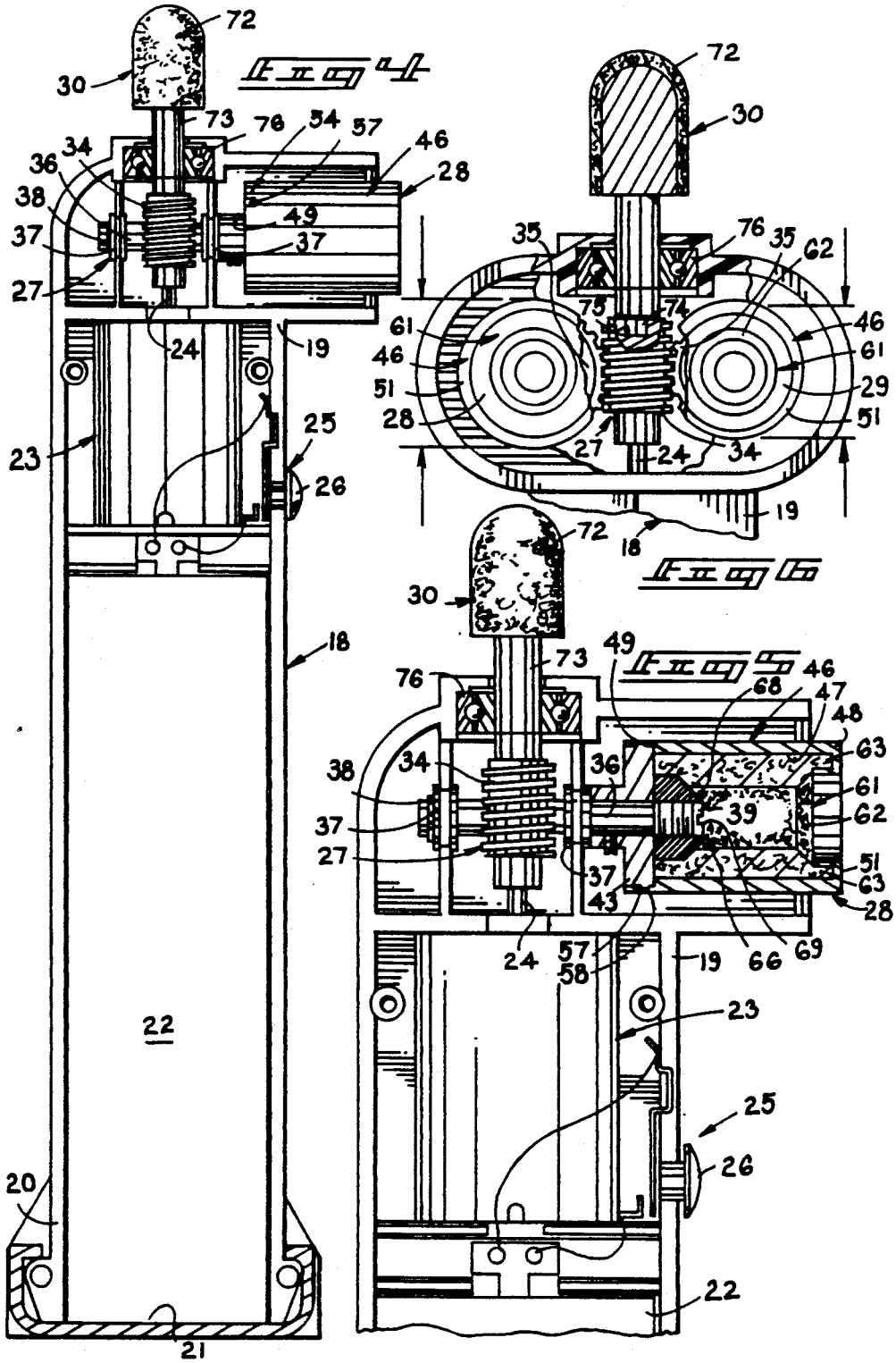
FIG. 4 is a longitudinal sectional view taken substantially along line 4—4 in FIG. 1.
FIG. 5 is an enlarged fragmented sectional view of the preferred tool showing an abrader head thereof in section.
FIG. 6 is a fragmented view as seen from the right in FIG. 5 to show attachment of a male abrader and details of a reducer mechanism.

The motor drive shaft 24 is connected to a reducer drive 27 adjacent the top end 19 of handle 18. The reducer drive 27, shown by way of example in FIGS. 4–6 is connected to a first abrader head 28, a second abrader head 29, and a male abrader 30.

The reducer drive 27, the abrader heads 28, 29 and the male abrader 30 are provided adjacent the top end 19 of the handle. They are arranged in such a manner that the device 10 is significantly compact and can be easily used in confined areas.

The preferred reducer drive 27 includes a worm gear 34 directly connected to the drive shaft 24. The worm gear 34 meshes with opposed worm wheels 35, one for each of the abrader heads 28, 29. The wheels 35 are mounted to shafts 36 which, in turn, are journaled in opposed bearings 37 within the handle top end 19. The worm wheels 35 are fixed to rotate with the shafts 36 on either side of the worm gear 34.

The shafts 36 preferably rotate about parallel axes situated on opposite sides of the worm gear 34 and the drive axis. The shafts 36 are held axially in place at outward ends by spring clips 38. Inward ends 39 of the shafts include turned threads. The threaded ends 39 of the shafts 36 ends receive the respective abrader heads 28 and 29.

The reducer, comprised of the worm and worm wheel arrangement substantially decreases the normal rotational speed of the motor shaft (preferably at a ratio of approximately 30 to 1) to result in a shaft 36 rotational rate of approximately 700 RPM and correspondingly increases the torque output at the abrader heads. The device therefore has ample power for the desired abrading tasks, yet is compact for use in confined areas.

The first and second abrader heads 28 and 29, with the exception of varying dimensions to accommodate different size tubular workpieces 11, are basically identical. Like reference numbers will therefore be assigned like elements of both abrader heads.

Each abrader head 28, 29 advantageously includes an abrasive mounting sleeve 46, and a female abrasive member 61. The abrader heads are secured by abrader head mounting bases 43 to the respective shafts 36 inwardly adjacent their threaded ends 39.

The abrader head mounting bases 43 on both shafts are advantageously of identical size to facilitate interchangeability of abrader heads. The bases 43 are secured to the shafts with appropriate devices (not shown) such as interfitting keys and keyways, set screws, splines, etc. that will transmit rotation of the shafts directly to the abrader head mounting bases 43.

The bases 43 are configured to releasably receive the abrader heads 28, 29. Further, by use of mounting devices 54 (further described below), the bases 43 will transmit rotary forces from the reducer drive 27 to the heads 28, 29.

Each abrader head is comprised of a rigid, female abrasive member receiving sleeve 46 coaxially with its associated shaft axis. The sleeves 46 may be formed, like handle 18, of injection molded plastic. They are substantially tubular in cross section, with an internal surfaces 47 extending between forward open ends 48 and rearward ends 49.

The rearward sleeve ends 49 are provided to snap over the abrader head bases 43 and secure themselves to the shafts for rotational motion. To this end, the mounting devices 54 are provided at the rearward sleeve ends 49.

Mounting devices 54 include rotary drive engaging surfaces in the form of sockets or notches 56 at the rearward ends of the sleeves 46. The notches are received over mating dogs or projections 57 on the abrader head mounting bases 43. The projections 57 and sockets 56 fit together to lock the sleeves against rotation relative to the bases 43 and shafts 36. The abrader heads will therefore rotate in direct response to rotation of the shafts 36.

The rearward ends 49 of the sleeves are preferably identical in size, regardless of the remaining sleeve dimensions, which may vary according to the size of tubing to be abraded. This facilitates interchangeability of sleeves with different forward opening sizes on the like sized abrader head bases 43. A one-half inch, three-quarter inch or other size adapted sleeve will therefore fit on either of the abrader head bases 43.

The sleeves 46 releasably snap over the abrader head bases 43 through provision of an annular detent surface 59 formed about each of the base peripheries. Mating surfaces 60 are provided along the internal configurations of the sleeves 46 at the rearward sleeve ends 49.

The snap mating detent surfaces 59, 60 enable the sleeve ends 49 to be easily attached to and removed from the bases 43 to facilitate interchangability.

The forward ends of the open sleeves 46 are supplied with flanges 51. The flanges 51 turn inward to secure the female abrasive members 61 within the first and second abrader heads 28 and 29.

The abrasive members 61 are situated within the sleeves 46 for abrasive engagement against the external surfaces of a tubular workpiece. Preferably, each abrasive member 61 is a pad of a flexible resilient abrasive material formed into a toroidal configuration. A preferred form of abrasive pad, especially for use with copper pipe is "Scotch Brite" brand abrasive pads sold by 3M Company of Minneapolis, Minn.

Each of the abrasive members 61 is formed to define a central axial opening 62 that is substantially coaxial with the rotational axis of the associated shaft 36. The diameters of the openings 62 from the rotational axes of the shafts 36 are slightly less than the external diameters of the selected tubular workpieces 11. An abrasive member 61, when fitted over a tube end, will compress slightly and resiliently, urging the abrasive surface into contact against the perimeter of the workpiece end.

The abrasive members 61 may be attached to the internal sleeve surfaces 47 either by clamping, as by the flanges 51, by an appropriate adhesive, or by both clamping and adhesive. How ever attached, forward edges 63 of the abrasive members are preferably situated within the flanged portions 51 of the sleeves. This prevents the leading edges of the abrasive members from being gouged and pulled loose by workpiece ends 12 upon insertion into the central abrasive member openings 62.

Figure 7:
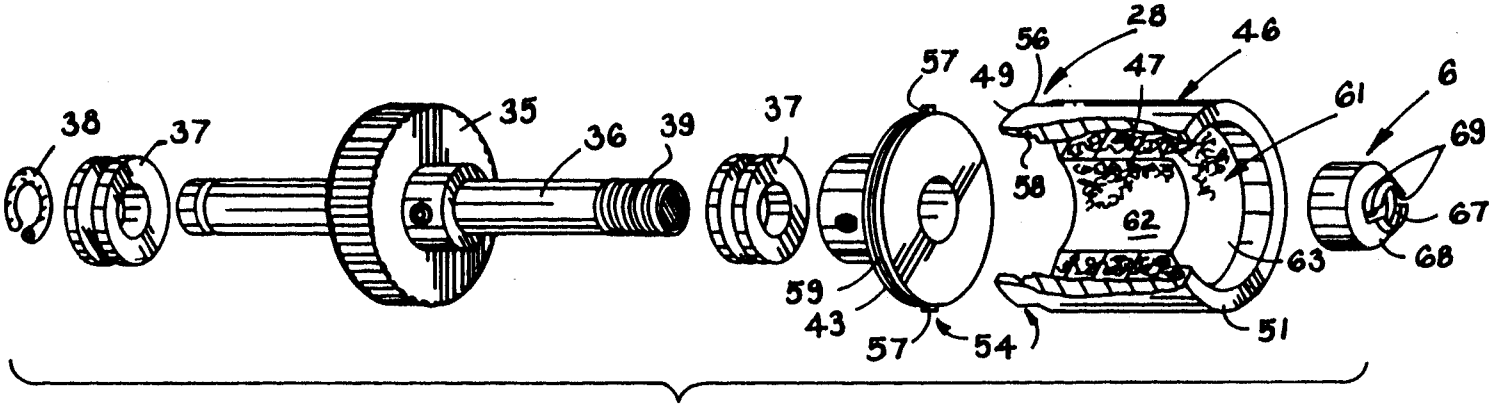
FIG. 7 is an exploded perspective view of an abrader head and a portion of a drive reducer.

A reamer is shown at 66 (FIGS. 5 and 7) that may be selectively mounted to one of the shaft threaded ends 39. Though a single reamer is shown, it is entirely conceivable that two reamers may be supplied, one for each of the abrader heads 28, 29. The reamers preferably vary in size, as do the abrasive members, to accommodate different tube sizes.

The reamer includes a central threaded socket 67 (FIG. 7) for threadably engaging the threaded shaft end 39. A beveled reamer edge 68 faces forwardly for rotation with the shaft to cut a beveled surface between the tube end 12 and the interior surface 13 thereof.

The reamer 66 is provided with a slot 69 or other appropriate surface for engagement by a tool such as a screwdriver to facilitate selective mounting and removal of the reamer from the threaded shaft end. This gives the user the ability to choose whether tube ends are to be reamed and facilitates removal and replacement of the reamer following wear.

The preferred male abrader 30 (FIGS. 4–6) includes a domed resilient abrasive pad 72. The pad may be formed of the same abrasive material as the abrasive members 61. It is shaped with a domed configuration along a top surface and includes a cylindrical configuration extending downwardly from the top. The abrasive material may be supplied over a rigid support matrix 71, formed of a molded material, preferably plastic, with a depending shank 73. The shank 73 is releasably attached to the worm gear 34 by a bearing 76 located at the top end of the housing.

The diameter of the male abrader at the cylindrical portion may vary with the internal diameter of the fitting to be abraded. Thus, different male abraders may be supplied with different diameters according to the various standard fitting inside diameters.

The shank 73 includes an end 74 that is shaped to be received within a complementary socket 75 (FIG. 6) in the reducer drive worm gear 34. The mating cross sectional configurations of the socket 75 and the shank end 74 may be polygonal in order to support the shaft within the socket and to transmit rotary motion of the driver 23 to the abrasive pad 72.

The socket 75 and shank 73 are provided so the male abrader 30 may be selectively removed from the device either for replacement due to wear, or to further reduce the overall length of the device when use is required in very confined areas.

Before the user operates the present device, a determination of the tubing and fitting size to be abraded is first made. If one-half inch tubing is to be abraded, an abrader head sized to accommodate one-half inch tubing is selected and attached to a selected abrader head base 43. If three-fourth inch tubing is also to be abraded, a second, three-quarter inch abrader head is assembled on the opposite shaft. These two sizes are typically sufficient to clean all fittings in a residential structure. The heads need only be changed when worn. This is done simply by removing the worn abrader head and by axially snapping the selected abrader head sleeves 46 and internal abrasive members 61 in place over the abrader head bases 43 already secured to the shafts 36.

If desired, a male abrader 30 may also be selected that corresponds with the internal diameter of the fittings to be abraded. The selected male abrader member is pushed axially into the top end of the handle with the shank end 74 sliding into the socket 75 of the worm gear 34. The device is now ready for use.

To operate the present device 10, the user may simply grasp the handle 18 in one hand with, say, the index finger in the vicinity of the switch 25. The user may then simply slide the selected sleeve 46 and abrasive member 61 axially over the end of the tube to be abraded. The switch 25 may then be actuated by the user's finger.

Resulting rotary motion of the driver 23 is transmitted and reduced through the reducer drive 27. The reducer drive, connected to the first and second abrader heads, transmits rotary motion from the driver to the abrader heads. The heads 28, 29 rotate continuously about their parallel axes as long as the switch 25 is depressed.

The rotating abrasive member 61, presently engaged about the circumference of the tube will abrade the external tube surface 14. As this is done, the user may wish to move the device axially in relation to the tube to assure complete surface abrasion of the engaged surface.

Additionally, if desired, the user may press the device axially inward to a point where a reamer 66, selectively threaded onto the adjacent shaft end 39, engages and reams a beveled edge at the juncture of the internal surface 13 and the tube end 12. The tube end is thus simultaneously abraded and reamed in one easy motion.

It is noted at this point that cleaning of the tube may take place in a relatively confined area, such as the space between subflooring and floor joists, or between wall studs. Tubing ends often project only a few inches from both the floor joist and adjacent subflooring, leaving very little space for either hand cleaning of the tube ends. The compact dimensions of the present device facilitates abrasion of tubes in such situations.

Fittings, on the other hand, are typically loose and may be prepared for connection to the tube ends prior to attachment. Thus, the user may simply place the fitting over the appropriately selected male abrader 30 for the purpose of cleaning the internal fitting surfaces. The various sockets or tube end receiving portions of the fitting may be all cleaned and abraded before the fitting is attached to the cleaned tube end.

Operation involved in cleaning the fitting is therefore similar to that of the tube, except that the abrasion occurs on the internal surfaces of the fitting and the fitting may be hand held as well as the device 10.

It may be understood from the above that the present device may be utilized to accomplish quick and effective cleaning of tube ends and fittings. In fact, it is estimated that the time taken to clean a tube end and the socket of a fitting is approximately five times faster than the amount of time required to accomplish the cleaning task by hand. This translates into significant savings when considering an overall complete construction project.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A tubular workpiece end abrading device for selectively abrading an end of a first or a second tubular workpiece, each workpiece being formed substantially about a central workpiece axis and terminating at an end including an internal surface and an external surface having a dimension different than the other workpiece, the device comprising:

a first abrader head mounting a first female abrasive member for rotation about a first rotary axis to coaxially receive the end of the workpiece with the first female abrasive member in abrasive contact against the external surface of the first workpiece;

a second abrader head mounting a second female abrasive member for receiving the end of the second workpiece with the second female abrasive member in abrasive contact therewith and for rotating the second abrasive member about a second rotary axis and against the external surface of the second workpiece;

a male abrader mounting a male abrasive member for rotation about a male abrader axis and for insertion into at least one of the tubular workpieces to engage the internal surface thereof;

a driver operable to produce rotational driving force about a driver axis angularly offset from the first rotary axis; and a reducer drive connecting the driver, the first and second abrader heads and male abrader for driven rotation about the first and second rotary axes and the male abrader axis respectively.

2. The device of claim 1 further comprising:

a reamer rotatably mounted to the first abrader head for rotary motion therewith to engage and ream the end of the first workpiece.

3. The device of claim 1 further comprising:

a reamer releasably connected to the reducer drive to be rotated thereby to ream the end of at least one of the workpieces.

4. The device of claim 1 wherein the first and second female abrasive members each include a flexible toroidal abrasive pad with a central opening for rotatably receiving and abrading the external surface of the respective workpiece.

5. The device of claim 4 further comprising:

a reamer mountable to the first abrader head within the central opening of the first female abrasive member for rotary motion therewith to engage and ream the end of the first workpiece.

6. The device of claim 1 wherein the second female abrasive member includes a flexible toroidal abrasive pad with a central opening for rotatably receiving and abrading the external surface of the second workpiece.

7. The device of claim 1 wherein the first and second abrader heads rotate about parallel axes and wherein the reducer drive includes a worm gear mounted to the driver and a worm wheel on each abrader head in meshing engagement with the worm gear on opposite sides thereof.

8. The device of claim 7 wherein the male abrader head rotates about an axis substantially coaxial with the driver axis and wherein the driver axis is situated between the parallel axes of the first and second abrader heads.

9. The device of claim 1 wherein the male abrader head rotates about an axis coaxial with the driver axis.

10. The device of claim 1 further comprising forwardly open sleeves releasably mounting the first and second female abrasive members to the first and second abrader heads.

11. The device of claim 10 further comprising a reamer connected to the reducer drive and situated within one of the sleeves for rotation therewith to engage and ream the end of the workpiece.

12. The device of claim 10 wherein the first female abrasive member is a flexible torroidal abrasive pad with a central opening for rotatably receiving and abrading the external surface of the workpiece.

13. The device of claim 10 further comprising a reamer releasably mounted to the first abrader head for rotation therewith to ream the end surface of the first tubular workpiece.

14. The device of claim 13 wherein the reamer is threadably engaged with the first abrader head within the sleeve and is axially inward of the first female abrasive member.

15. The device of claim 1 further comprising a sleeve releasably mounting the first female abrasive member to the first abrader head.

16. The device of claim 1 wherein the female abrasive members are comprised of resilient abrasive pads formed into a torroidal configurations and supported on internal surfaces of sleeve members including base end fitting releasably connectable to the reducer drive for supporting the pads and transmitting driving forces from the reducer drive to the pads.

17. A tube end abrading tool for mounting abrasive members to selectively abrade ends of tubular workpieces, having differing diameters formed substantially about central workpiece axes and terminating at ends including interior and external surfaces, the tool comprising:

a handle extending from a bottom end to a top end;

a first abrader head at the top end of the handle, mounting a first female abrasive member for rotation about a first rotary axis substantially transverse to the handle to selectively receive the end of a workpiece of a first diameter with the first female abrasive member in abrasive contact therewith against the external surface of the workpiece;

a second abrader head at the top end of the handle, rotatably mounting a second female abrasive member adjacent the first abrader head for selectively receiving the end of a second workpiece of a second diameter with the second female abrasive member in abrasive contact against the external surface of the second workpiece and rotatable about a second rotary axis;

a male abrader head at the top end of the handle, rotatably mounting a male abrasive member for insertion into at least one of the tubular workpieces to engage the internal surface thereof;

a driver in the handle downwardly of the abrader heads for selective operation to produce rotary driving force about a drive axis substantially perpendicular to the first and second rotary axes; and a reducer drive operably connecting the driver and the abrader heads for transmitting rotary driving force of the driver to rotate the abrader heads.

18. The device of claim 17 wherein the first and second abrader heads rotate about parallel axes and wherein such axes are substantially perpendicular to the drive axis and to the male abrader head.

19. The device of claim 17 wherein the female abrader heads each include a resilient abrasive pad formed into a torroidal configuration supported on an internal surface of a sleeve member including a fitting releasably connectable to the reducer drive for supporting the pad and transmitting driving forces from the reducer drive to the pad.

20. The device of claim 17 wherein the male abrasive member is comprised of a resilient abrasive pad shaped as a cylinder with a top end and a shank extending downwardly from the pad with an end thereof releasably attachable to the reducer drive.

21. The device of claim 17 wherein the first and second abrader heads rotate about parallel axes.

22. An abrader head for a tube end abrading tool having a rotary drive, the abrader head comprised of:

a sleeve member including a forward open end, a rearward end, and an inward surface between the forward and rearward ends formed substantially about a central axis;

a mounting device on the rearward end of the sleeve member for attachment to the abrading tool;

the mounting device including a surface selectively engageable with the rotary drive of the tool to transmit rotary motion of the drive to the sleeve member; and an abrasive member in the sleeve member, attached to the inward surface for abrasive contact with a tube end and for abrading the tube end responsive to rotary motion of the sleeve member about the central axis;

wherein the abrasive member is comprised of a resilient abrasive pad formed into a torroidal configuration and supported on an internal surface of the sleeve member; and wherein the sleeve member includes an axially rearward projecting flange at the forward open end thereof and wherein one of the abrasive member ends is axially overlapped and clamped by the flange to the inward surface of the sleeve member.

* * * * *